US007922275B2

(12) United States Patent
Sudo et al.

(10) Patent No.: US 7,922,275 B2
(45) **Date of Patent: *Apr. 12, 2011**

(54) LIQUID EJECTION CONTROLLING METHOD AND LIQUID EJECTION APPARATUS

(75) Inventors: Naoki Sudo, Hatsumoto (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 689 days.

This patent is subject to a terminal disclaimer.

(21) Appl. No.: 11/972,535

(22) Filed: Jan. 10, 2008

(65) Prior Publication Data

US 2008/0174624 A1 Jul. 24, 2008

(30) Foreign Application Priority Data

Jan. 17, 2007 (JP) ..... 2007-008527
Nov. 28, 2007 (JP) ..... 2007-307772

(51) Int. Cl.
*B41J 2/195* (2006.01)

(52) U.S. Cl. ..... 347/7; 347/19; 347/84; 347/86

(58) Field of Classification Search ..... None
See application file for complete search history.

(56) References Cited

U.S. PATENT DOCUMENTS 5,250,957 A * 10/1993 Onozato ..... 347/7
6,970,262 B1 * 11/2005 Saito ..... 358/1.15

FOREIGN PATENT DOCUMENTS

JP 2003-001842 1/2003
JP 2003-291324 10/2003

* cited by examiner

*Primary Examiner* — Matthew Luu
*Assistant Examiner* — Justin Seo
(74) *Attorney, Agent, or Firm* — DLA Piper LLP (US)

(57) ABSTRACT

A remaining amount detecting step is performed by a first controller, in which a remaining amount of a liquid contained is detected for each of a plurality of cartridges containing the liquid to be ejected from nozzles. An information transmitting step is performed by the first controller, in which when the remaining amount of the liquid in at least one of the cartridges is detected to be equal to or lower than a predetermined amount, information relating to a cartridge with a small remaining amount is transmitted, the cartridge with the small remaining amount corresponding to the at least one of the cartridges. A liquid ejection data generating step is performed by a second controller, in which at least one cartridge other than the cartridge with the small remaining amount is determined as a substitute cartridge based on the information, relating to the cartridge with the small remaining amount, that has been transmitted, and liquid ejection data for controlling ejection of the liquid contained in the substitute cartridge is generated and transmitted. The remaining amount information obtaining step is performed by the second controller, in which information relating to a remaining amount of the liquid of the substitute cartridge is obtained from the first controller each time a process of transmitting the liquid ejection data is performed, after the information relating to the cartridge with the small remaining amount has been received.

9 Claims, 9 Drawing Sheets

| DOT SIZE | INK CONSUMPTION AMOUNT (pl) |
|---|---|
| LARGE DOT | $\alpha$ |
| MEDIUM DOT | $\beta$ |
| SMALL DOT | $\gamma$ |

LIQUID EJECTION CONTROLLING METHOD AND LIQUID EJECTION APPARATUS

CROSS-REFERENCE TO RELATED APPLICATIONS

The present application claims priority of Japanese Patent Application No. 2007-8527 filed on Jan. 17, 2007 and Japanese Patent Application No. 2007-307772 filed on Nov. 28, 2007, the entire disclosure of which are herein incorporated by reference.

BACKGROUND

1. Technical Field

The present invention relates to liquid ejection controlling methods and liquid ejection apparatuses.

2. Related Art

An inkjet printer is known as a liquid ejection apparatus. The inkjet printer ejects various colors of ink, cyan (C), magenta (M), yellow (Y) or black (K) for example, onto a medium such as paper. Images are printed on the medium with ejected ink. Such various colors of ink, cyan (C), magenta (M), yellow (Y) or black (K) for example, are separately contained in cartridges mounted to the inkjet printer. When an ink in a cartridge has run out, printing can be resumed by replacing that cartridge with a new cartridge containing the same ink.

As this type of inkjet printer, a printer has been proposed in which a plurality of cartridges that contain the same color of ink are mounted. Specifically, an inkjet printer has been proposed in which two cartridges that contain, black (K) ink for example, can be mounted. It has been proposed in such an inkjet printer to use, when the remaining amount of ink contained in one of the two cartridges that contain the same color of ink has become small, the other cartridge that contains the same color of ink (see JP-A-2003-1842). In addition, a method has also been proposed in which when the remaining amount of ink in a certain cartridge has become small, another cartridge that contains a different color of ink is used as a substitute (see JP-A-2003-291324).

In such an inkjet printer, the computer side, which is a personal computer connected to the inkjet printer for example, makes an inquiry to the inkjet printer from time to time for the remaining amount of ink, so as to check the remaining amount of ink contained in each mounted cartridge. This is because it is necessary for the computer side to generate print data corresponding to the cartridge to be used, when the inkjet printer executes a printing process. That is, when another cartridge is used instead of a cartridge whose remaining amount of ink is small, it is necessary to generate print data reflecting such use of the other cartridge on the computer side.

However, making an inquiry for the remaining amount of ink in each cartridge from the computer side each time the inkjet printer executes the printing process makes the communications between the computer and the inkjet printer complicated, and also may interrupt processes to be performed on the computer side, which is problematic.

SUMMARY

The invention was made in view of such circumstances, and the principal advantage thereof is to reduce the burden related to communications.

A primary aspect of the invention is a liquid ejection controlling method described below.

A liquid ejection controlling method including:

a remaining amount detecting step of detecting a remaining amount of a liquid contained for each of a plurality of cartridges containing the liquid to be ejected from nozzles, the remaining amount detecting step being performed by a first controller;

an information transmitting step of transmitting information relating to a cartridge with a small remaining amount, when the remaining amount of the liquid in at least one of the cartridges is detected to be equal to or lower than a predetermined amount, the cartridge with the small remaining amount corresponding to the at least one of the cartridges, the information transmitting step being performed by the first controller;

a liquid ejection data generating step of generating and transmitting liquid ejection data for controlling ejection of a liquid contained in a substitute cartridge, by determining at least one cartridge other than the cartridge with the small remaining amount as the substitute cartridge based on the information, relating to the cartridge with the small remaining amount, that has been transmitted, the liquid ejection data generating step being performed by a second controller; and a remaining amount information obtaining step of obtaining information relating to a remaining amount of the liquid of the substitute cartridge from the first controller each time a process of transmitting the liquid ejection data is performed, after the information relating to the cartridge with the small remaining amount has been received, the remaining amount information obtaining step being performed by the second controller.

Features and advantages of the invention other than the above will become clear by reading the description of the present specification with reference to the accompanying drawings.

BRIEF DESCRIPTION OF THE DRAWINGS

For a more complete understanding of the invention and the advantages thereof, reference is now made to the following description taken in conjunction with the accompanying drawings wherein.

DESCRIPTION OF EXEMPLARY EMBODIMENTS

Figure 1:
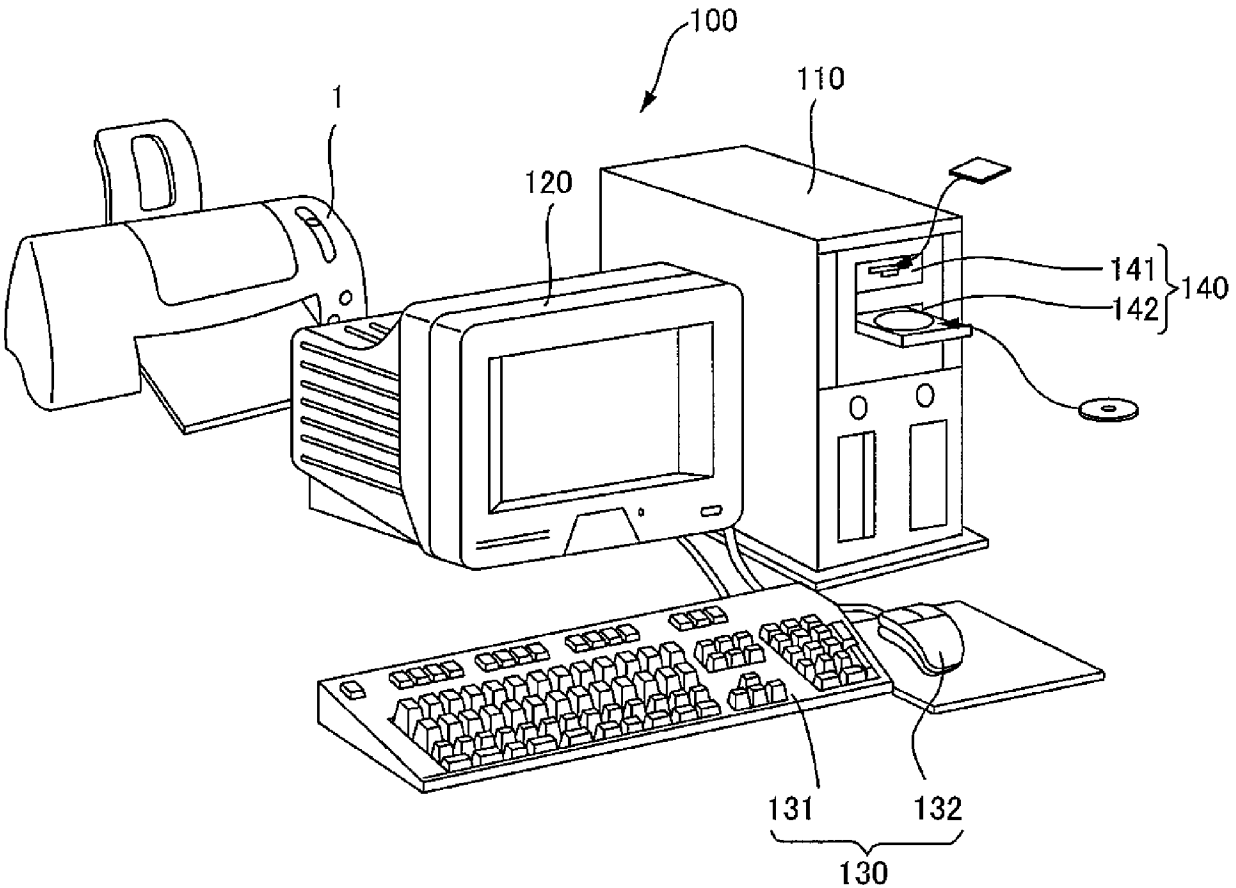
FIG. 1 is a perspective view showing an exemplary configuration of a liquid ejection system.

At least the following matters will be made clear by reading the description of the present specification with reference to the accompanying drawings.

First, it is made clear that the following liquid ejection controlling method can be realized.

A liquid ejection controlling method including:

a remaining amount detecting step of detecting a remaining amount of a liquid contained for each of a plurality of cartridges containing the liquid to be ejected from nozzles, the remaining amount detecting step being performed by a first controller;

an information transmitting step of transmitting information relating to a cartridge with a small remaining amount, when the remaining amount of the liquid in at least one of the cartridges is detected to be equal to or lower than a predetermined amount, the cartridge with the small remaining amount corresponding to the at least one of the cartridges, the information transmitting step being performed by the first controller;

a liquid ejection data generating step of generating and transmitting liquid ejection data for controlling ejection of a liquid contained in a substitute cartridge, by determining at least one cartridge other than the cartridge with the small remaining amount as the substitute cartridge based on the information, relating to the cartridge with the small remaining amount, that has been transmitted, the liquid ejection data generating step being performed by a second controller; and a remaining amount information obtaining step of obtaining information relating to a remaining amount of the liquid of the substitute cartridge from the first controller each time a process of transmitting the liquid ejection data is performed, after the information relating to the cartridge with the small remaining amount has been received, the remaining amount information obtaining step being performed by the second controller.

With such a liquid ejection controlling method, the second controller is not required to obtain the information on the remaining amount of liquid from the first controller, until it is detected that the remaining amount of liquid in at least one of a plurality of cartridges is a predetermined amount or lower. In this manner, the burden related to communications can be mitigated. Also, after the cartridge with the small remaining amount is detected, by using the liquid in a substitute cartridge instead of the liquid in the cartridge with the small remaining amount, the liquid consumption amount of the cartridge with the small remaining amount can be suppressed. Also, after the cartridge with the small remaining amount is detected, by obtaining the information relating to the remaining amount of liquid in the substitute cartridge from the first controller, the second controller can easily manage the remaining amount in the substitute cartridge.

In such a liquid ejection controlling method, it is preferable that in the remaining amount information obtaining step the information relating to the remaining amount of the liquid is not obtained from the first controller until the information relating to the cartridge with the small remaining amount has been received.

With such a liquid ejection controlling method, the burden related to communications between the first controller and the second controller can be mitigated.

In such a liquid ejection controlling method, it is preferable that the liquid contained in the substitute cartridge is a same type of liquid as the liquid contained in the cartridge with the small remaining amount.

With such a liquid ejection controlling method, instead of the liquid contained in the cartridge with the small remaining amount, the liquid contained in the substitute cartridge can be easily used.

In such a liquid ejection controlling method, it is preferable that the liquid is ink.

With such a liquid ejection controlling method, at the time of printing an image, the burden related to communications between the first controller and the second controller can be mitigated.

In such a liquid ejection controlling method, it is preferable that the substitute cartridge contains a same color of ink as the ink contained in the cartridge with the small remaining amount.

With such a liquid ejection controlling method, instead of the ink contained in the cartridge with the small remaining amount, it is possible to easily use the ink stored in the substitute cartridge.

In such a liquid ejection controlling method, it is preferable that in the liquid ejection data generating step liquid ejection data for controlling ejection of liquids contained in a cartridge serving as the substitute cartridge and a cartridge serving as the cartridge with the small remaining amount is generated and transmitted such that these cartridges are alternately used, until the information relating to the cartridge with the small remaining amount has been received.

With such a liquid ejection controlling method, it is possible to suppress a situation in which the remaining amount in one cartridge unevenly decreases compared to the remaining amount in the other cartridge.

In such a liquid ejection controlling method, it is preferable that it includes:

a difference calculating step of calculating a difference between the remaining amount of the liquid contained in the cartridge with the small remaining amount and the remaining amount of the liquid contained in the substitute cartridge, based on information relating to the remaining amount of the liquid obtained from the first controller, the difference calculating step being performed by the second controller; and a difference determining step of determining whether or not the calculated difference is equal to or lower than a predetermined value, the difference determining step being performed by the second controller.

With such a liquid ejection controlling method, it can be recognized whether or not the remaining amounts in the cartridge with the small remaining amount and the substitute cartridge are becoming equal.

In such a liquid ejection controlling method, it is preferable that wherein in the remaining amount information obtaining step, when it has been determined that the difference is equal to or lower than the predetermined amount, the information relating to the remaining amount of the liquid in the substitute cartridge and the information relating to the remaining amount of the liquid in the cartridge with the small remaining amount is obtained form the first controller, and wherein in the liquid ejection data generating step a cartridge with the larger remaining amount is determined of the substitute cartridge and the cartridge with the small remaining amount, based on the information relating to the remaining amount of the liquid of the substitute cartridge and the information relating to the remaining amount of the liquid of the cartridge with the small remaining amount, and liquid ejection data for controlling ejection of the liquid contained in the cartridge with the larger remaining amount is generated and transmitted.

With such a liquid ejection controlling method, both cartridges whose remaining amounts have become small can be used equally.

Also, it is made clear that the following liquid ejection apparatus can be realized.

A liquid ejection apparatus, including:

(A) a first controller that performs a remaining amount detecting step and an information transmitting step, in the remaining amount detecting step detecting a remaining amount of a liquid contained for each of a plurality of cartridges containing the liquid to be ejected from nozzles, and in the information transmitting step when the remaining amount of the liquid in at least one of the cartridges is detected to be equal to or lower than a predetermined amount, transmitting information relating to a cartridge with a small remaining amount, the cartridge with the small remaining amount corresponding to the at least one of the cartridges; and (B) a second controller that can communicate with the first controller, that performs a liquid ejection data generating step, and a remaining amount information obtaining step, in the liquid ejection data generating step generating and transmitting liquid ejection data for controlling ejection of the liquid contained in the substitute cartridge, by determining at least one cartridge other than the cartridge with the small remaining amount as a substitute cartridge based on the information, relating to the cartridge with the small remaining amount, that has been transmitted, and in the remaining amount information obtaining step obtaining information relating to a remaining amount of the liquid of the substitute cartridge from the first controller each time a process of transmitting the liquid ejection data is performed, after the information relating to the cartridge with the small remaining amount has been received.

Outline of Liquid Ejection System

A liquid ejection system 100 includes an inkjet printer 1 and a computer 110 (see FIG. 1). Here, since the printer 1 ejects ink in the form of liquid onto paper, which is one type of media, the printer 1 corresponds to a liquid ejection apparatus in a narrow sense. The computer 110 controls operations of the printer 1 through transmitting print data, etc. Therefore, the liquid ejection system 100 corresponds to a liquid ejection apparatus in a broad sense. The invention will be described below using this liquid ejection system 100 as an example.

Overall Configuration

FIG. 1 is a diagram showing a configuration of the liquid ejection system 100. The illustrated liquid ejection system 100 includes the inkjet printer 1, which is one type of printing apparatus, and the computer 110. The computer 110 is communicably connected to a display device 120, an input device 130, and a recording/reproducing device 140. The computer 110 is communicably connected to the inkjet printer 1 as well. In order to print an image with the inkjet printer 1, the computer 110 generates print data corresponding to that image, and transmits the print data to the inkjet printer 1. This print data corresponds to "liquid ejection data".

The computer 110 has computer programs such as an application program and a printer driver installed thereon. The display device 120 is configured of a liquid crystal display, CRT display and the like. In the display device 120, for example, user interfaces of application programs installed on the computer 110 or computer programs such as a printer driver are displayed. The input device 130 is configured of, for example, a keyboard 131 and a mouse 132. The recording/reproducing device 140 is configured of, for example, a flexible disk drive device 141 or a CD-ROM drive device 142.

Internal Configuration of Inkjet Printer

Figure 2:
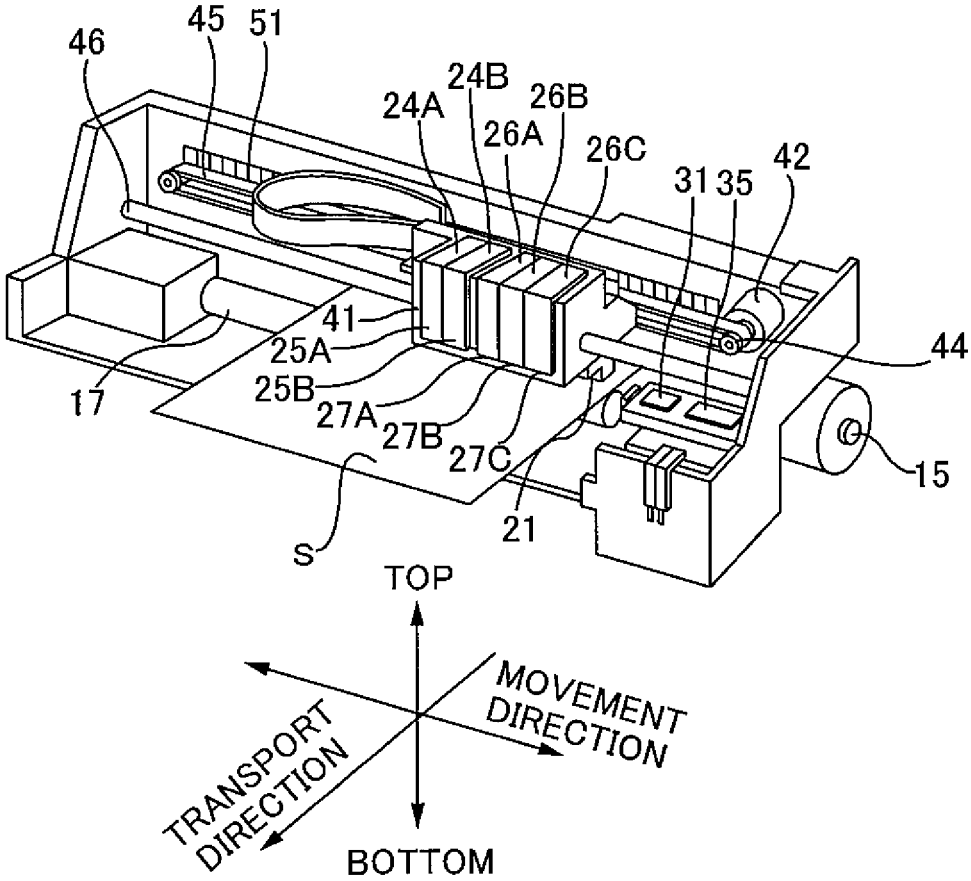
FIG. 2 is a perspective view showing the internal configuration of a printer.

FIG. 2 shows the internal configuration of an inkjet printer. A carriage 41 is provided inside the inkjet printer 1, as shown in FIG. 2. This carriage 41 is provided so that it can move back and forth, in the right-to-left direction as viewed from the front of the printer 1 (carriage movement direction). A carriage motor 42, a pulley 44, a timing belt 45, and a guide rail 46 are provided in the vicinity of the carriage 41. The carriage motor 42 is constituted by a DC motor or the like and functions as a driving power source for moving the carriage 41 along the carriage movement direction. The timing belt 45 is connected via the pulley 44 to the carriage motor 42, and a part of it is also connected to the carriage 41, such that the carriage 41 is moved along the carriage movement direction due to the rotational drive of the carriage motor 42. The guide rail 46 guides the carriage 41 along the carriage movement direction.

In addition, a linear encoder 51 that detects the position of the carriage 41, a transport roller 17 for transporting the medium S along a transport direction intersecting the carriage movement direction, and a transport motor 15 that rotatably drives the transport roller 17 are provided in the vicinity of the carriage 41.

On the other hand, the carriage 41 is provided with ink cartridges 24A, 24B, 26A, 26B, and 26C that contain various types of ink and a head 21 that carries out printing on the medium S. The ink cartridges 24A, 24B, 26A, 26B, and 26C contain various colors of ink such as yellow (Y), magenta (M), cyan (C), and black (K). Furthermore, in the present embodiment, the two ink cartridges 24A and 24B are provided as the black (K) ink cartridges. These ink cartridges 24A, 24B, 26A, 26B, and 26C are mounted in cartridge mounting sections 25A, 25B, 27A, 27B, and 27C provided in the carriage 41 in a removable manner.

Furthermore, in the present embodiment, the head 21 carries out printing by ejecting ink onto the medium S. For this reason, the head 21 is provided with a large number of nozzles for ejecting ink.

In addition to the above, the internal portion of the inkjet printer 1 is provided with, for example, a pump device 31 for pumping ink from the nozzles such that clogging in the nozzles of the head 21 is eliminated, and a capping device 35 for capping the nozzles of the head 21 when printing is not being performed (when being on standby, for example) so as to prevent clogging in the nozzles of the head 21.

Configuration of the Head

Figure 3:
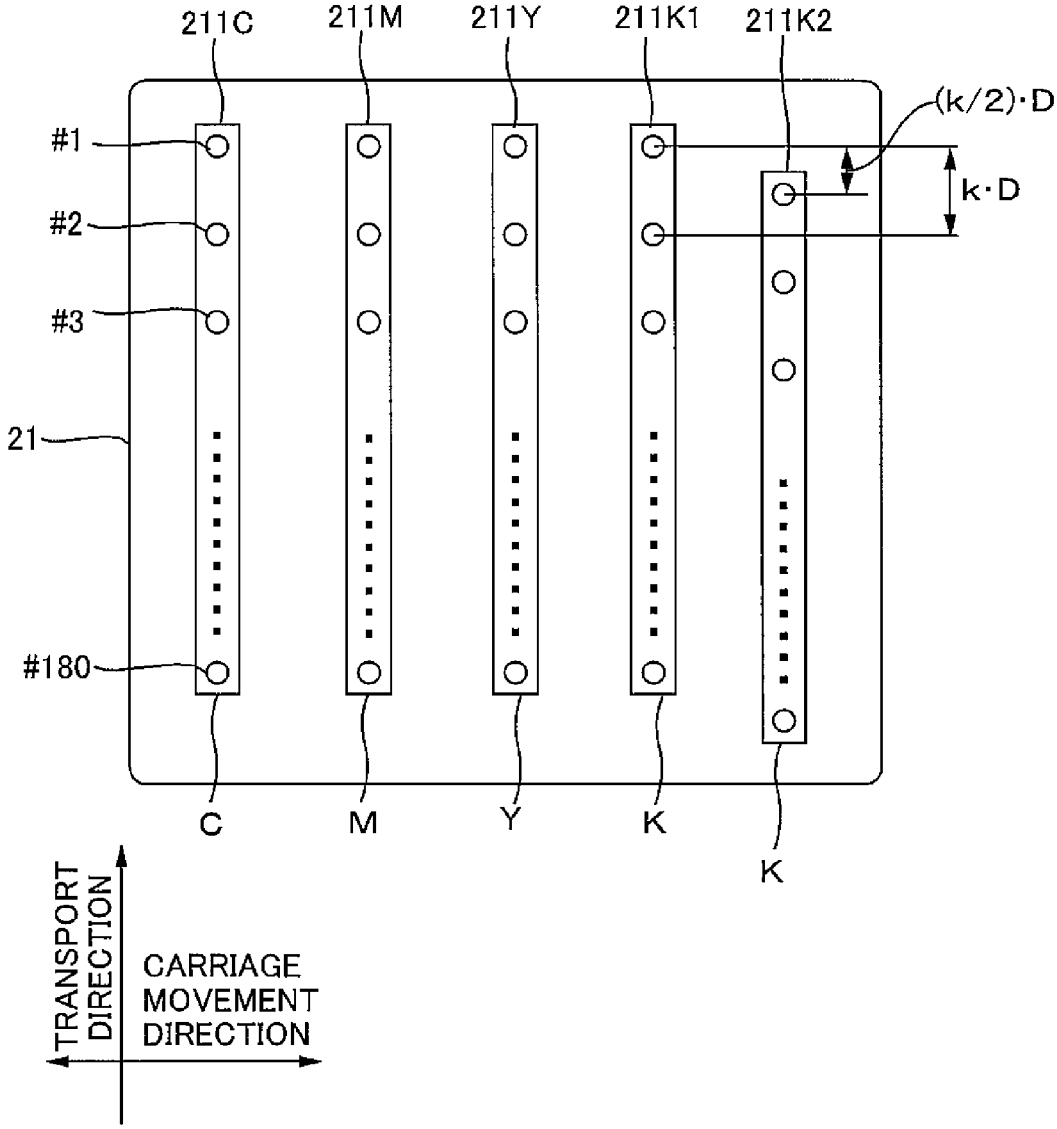
FIG. 3 is an explanatory diagram of the configuration of nozzle rows of a head.

FIG. 3 shows the arrangement of nozzles in a lower face of the head 21. As shown in FIG. 3, a plurality of types of nozzle groups that eject various colors of ink are provided in the lower face of the head 21. In the present embodiment, a yellow nozzle group 211Y that ejects yellow (Y) ink, a magenta nozzle group 211M that ejects magenta (M) ink, a cyan nozzle group 211C that ejects cyan (C) ink, and two black nozzle groups that ejects black (K) ink (namely, a first black nozzle group 211K1 and a second black nozzle group 211K2) are provided as nozzle groups in the head 21. These nozzle groups 211Y, 211M, 211C, 211K1, and 211K2 are provided respectively corresponding to ink cartridges for various colors, 24A, 24B, 26A, 26B, and 26C. These ink cartridges 24A, 24B, 26A, 26B, and 26C are mounted respectively corresponding to the cartridge mounting sections 25A, 25B, 27A, 27B, and 27C provided in the carriage 41.

Each of the nozzle groups 211Y, 211M, 211C, 211K1, and 211K2 is provided with a plurality of nozzles that serve as an ejection opening for ejecting ink. In the present embodiment, 180 nozzles, nozzles #1 to #180, are provided. The nozzles #1 to #180 of each of the nozzle groups 211Y, 211M, 211C, 211K1, and 211K2 are linearly arranged at a constant spacing (nozzle pitch: k·D) along the transport direction. Here "D" is a minimum dot pitch in the transport direction (that is, the spacing at a maximum resolution of dots formed on the paper S). Also, "k" is an integer of 1 or more. For example, if the nozzle pitch is 120 dpi (1/120 inch) and the dot pitch in the transport direction is 360 dpi (1/360 inch), then k=3.

In the present embodiment, the second black nozzle group 211K2 is disposed so as to be shifted in the transport direction relative to the first black nozzle group 211K1 by half the nozzle pitch, that is (k/2·D). It should be noted that the first black nozzle group 211K1 is disposed aligned with other nozzle groups, namely, the yellow nozzle group 211Y, magenta nozzle group 211M, cyan nozzle group 211C. Only the second black nozzle group 211K2 is disposed shifted relative to the first black nozzle group 211K1, yellow nozzle group 211Y, magenta nozzle group 211M, and cyan nozzle group 211C.

The nozzles #1 to #180 of each of the nozzle groups 211Y, 211M, 211C, 211K1, and 211K2 are assigned a number that becomes smaller for nozzles further downstream in the transport direction of the medium S. That is, the nozzle #1 is positioned further downstream in the transport direction than the nozzle #180. Piezo elements (not shown) are provided corresponding to each of the nozzles #1 to #180. The piezo element corresponds to a driving element for ejecting ink. The piezo element is deformed as a result of a voltage of a certain time interval being applied to electrodes that hold a piezoelectric substance therebetween. When the piezo element is deformed, the sidewall of the ink flow channel is deformed as well. Then, part of the ink flow channel constricts in response to the deformation of the piezo element, and ink droplets are ejected from corresponding nozzles #1 to #180.

System Configuration

Figure 4:
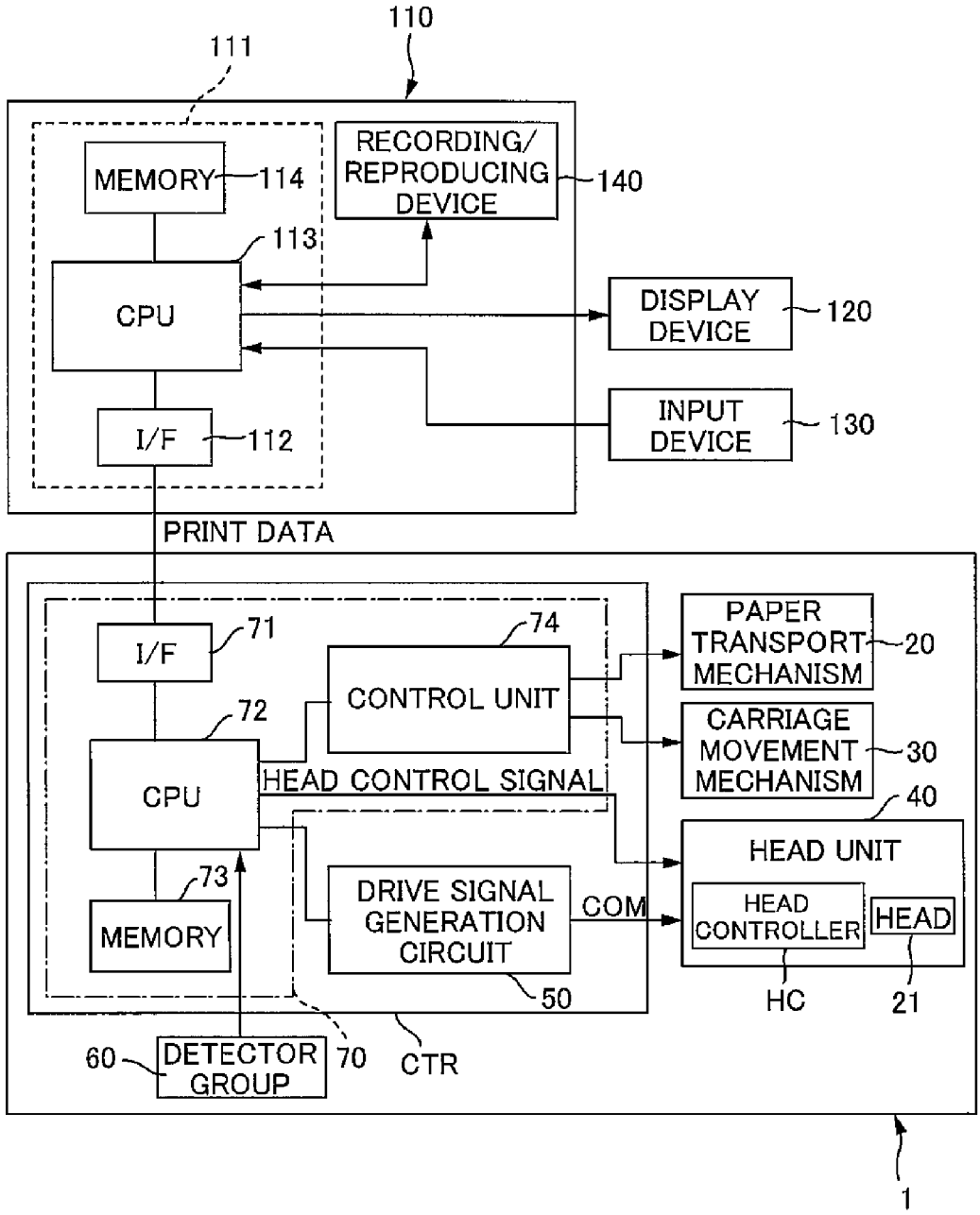
FIG. 4 is a block diagram illustrating the configuration of a computer and a printer.

FIG. 4 is a block diagram showing the configuration of the computer 110 and the inkjet printer 1. The computer 110 includes an external interface section (I/F) 112, a CPU 113, and a memory 114. The external interface section 112 is interposed between the computer 110 and the inkjet printer 1 so as to perform data communication. The CPU 113 is a computer processing device for carrying out overall control of the computer 110. The memory 114 is for reserving a working region and a region for storing the computer programs for the CPU 113, for instance. The memory 114 is configured of a RAM, an EEPROM, a ROM, or a magnetic disc device, for example. Computer programs stored in the memory 114 include the application programs and printer driver described above. The CPU 113 performs various controls in accordance with the computer programs stored in the memory 114.

This print data refers to data in a format that can be interpreted by the inkjet printer 1. The print data includes various types of command data and pixel data. The command data refers to data for instructing the inkjet printer 1 to carry out a particular operation. The command data includes, for example, command data for instructing paper supply, command data that indicates a transport amount, and command data for instructing paper discharge.

The pixel data refers to data related to pixels which compose the image to be printed. Here, the pixel data is constituted by data (for example, tone values of dots) related to dots to be formed on paper corresponding to pixels that compose an image to be printed. In the present embodiment, pixel data is constituted by two-bit data. To be more precise, pixel data includes data [00] corresponding to no dot (no ejection of ink), data [01] corresponding to the formation of a small dot, data [10] corresponding to the formation of a medium dot, and data [11] corresponding to the formation of a large dot. In other words, the inkjet printer 1 can print images in which a single pixel can be expressed in four tones.

The computer 110 generates the print data (liquid ejection data). Also, as described below, when an ink cartridge with a small remaining amount, which is an ink cartridge for which the remaining amount of ink has become a predetermined amount or lower, has been detected, the computer 110 designates a substitute ink cartridge used instead and generates print data for that substitute ink cartridge. In addition, the computer 110 calculates the difference between the remaining amounts of ink in the ink cartridge with a small remaining amount and the substitute ink cartridge, or makes determinations based on such difference. The computer 110 that carries out such operations corresponds to a second controller.

On the other hand, the inkjet printer 1 has a paper transport mechanism 20, a carriage movement mechanism 30, a head unit 40, a drive signal generation circuit 50, a detector group 60, and a controller 70. The controller 70 has a CPU 72, an external interface section (I/F) 71, a memory 73, and a control unit 74. The control unit 74 controls the paper transport mechanism 20 and the carriage movement mechanism 30 in accordance with the commands from the CPU 72. The external interface section (I/F) 71 performs data communications with the external interface section (I/F) 112 of the computer 110. Programs executed by the CPU 72 and various data are stored in the memory 73. The CPU 72 controls the control unit 74, the drive signal generation circuit 50, the head unit 40 and the like. As described later, the controller 70 in the present embodiment detects the remaining amount of ink contained in the ink cartridges 24A, 24B, 26A, 26B, and 26C. When it is detected that the remaining amount of ink in a certain ink cartridge is a predetermined amount or lower, the controller 70 generates information relating to that ink cartridge and sends the information to the computer 110. The controller 70 that carries out such operations corresponds to a first controller.

Moreover, the head unit 40 has a head controller HC and the head 21. The head controller HC controls the head 21 in accordance with the commands from the CPU 72. The head 21 includes a plurality of nozzles, and performs printing by ejecting ink from the respective nozzles onto a medium.

The detector group 60 detects the conditions in various sections in the inkjet printer 1, and transmits the detection results to the controller 70. The detector group 60 includes the linear encoder 51 and the like. The controller 70 receives detection results from the detection group 60 and controls the control target sections based on the detection results.

Printer Driver

Figure 5:
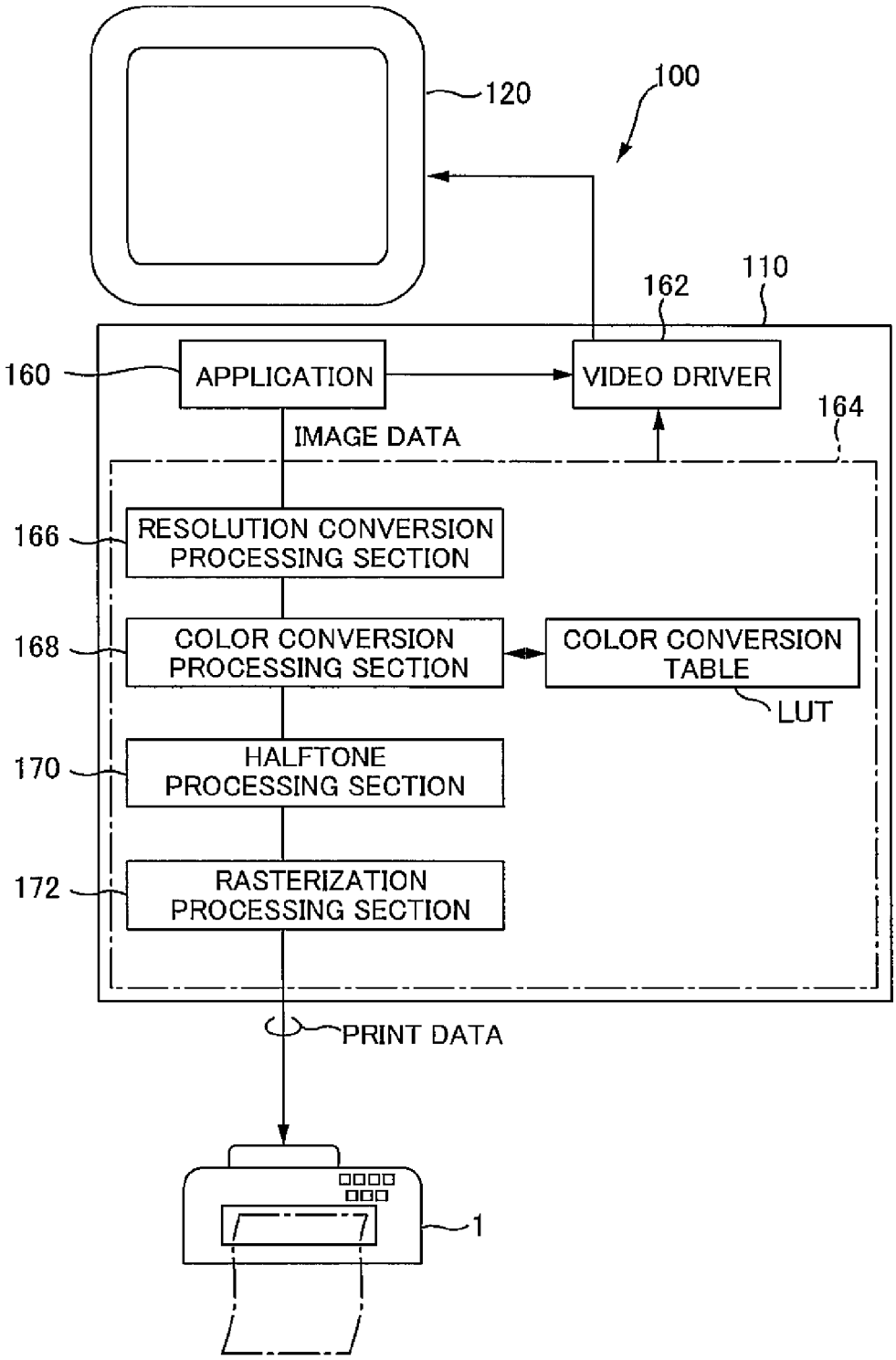
FIG. 5 is an explanatory diagram of the processes performed by a printer driver.

The printer driver is described next. The printer driver is a program installed on the computer 110, and is for controlling the inkjet printer 1. FIG. 5 describes the outline of the processes performed by the printer driver.

In the computer 110, various computer programs such as a video driver 162, an application program 160, or a printer driver 164 are executed under the operating system installed on the computer 110. The video driver 162 has the function of displaying user interfaces, for example, on the display device 120 in accordance with display commands from the application program 160 or the printer driver 164. The application program 160, for example, has a function for image editing or the like and creates data relating to an image (image data). A user can give an instruction to print an image edited with the application program 160 via the user interface of the application program 160. Upon receiving the print instruction, the application program 160 outputs the image data to the printer driver 164.

The printer driver 164 receives the image data from the application program 160, converts the image data into print data, and outputs the print data to the inkjet printer 1. Here, "print data" refers to data in a format that can be interpreted by the inkjet printer 1 and that includes various command data and pixel data. Also, "command data" refers to data for instructing the inkjet printer 1 to carry out a specific operation. The pixel data refers to data relating to pixels which constitute the image to be printed (printed image). For example, the pixel data refers to data relating to a dot to be formed in a position on the medium S corresponding to a certain pixel (color and size of dot, etc.). The size of dots is determined depending on the amount of ink ejected from the nozzles #1 to #180. Therefore, the pixel data indicates the amount of ink ejected from the nozzles #1 to #180 for each dot tone value. Accordingly, the print data (pixel data) corresponds to liquid ejection data for controlling ejection of liquid.

The printer driver 164 converts image data outputted from the application program 160 to print data. For this purpose, the printer driver 164 includes a resolution conversion processing section 166, a color conversion processing section 168, a halftone processing section 170, and a rasterization processing section 172. The following is a description of the processes carried out by the various processing sections 166, 168, 170, and 172 of the printer driver 164.

The resolution conversion processing section 166 performs a resolution conversion process in which image data (text data, image data, etc.) outputted from the application program 160 is converted to a resolution for printing on the medium S. For example, when the resolution for printing an image on paper is specified as 720×720 dpi, then the resolution conversion process converts the image data received from the application program 160 to image data of a resolution of 720×720 dpi. It should be noted that, after the resolution conversion process, the image data is multi-gradation RGB data (for example, 256 gradations) that is expressed in RGB color space. Hereinafter, RGB data obtained by subjecting image data to resolution conversion processing is referred to as "RGB image data".

The color conversion processing section 168 performs a color conversion process in which RGB data is converted to CMYK data that is expressed in CMYK color space. It should be noted that CMYK data is data that corresponds to the ink colors of the inkjet printer 1. The color conversion process is carried out by the printer driver 164 referencing a table (a color conversion look-up table LUT) in which gradation values of RGB image data are associated with gradation values of CMYK image data. By this color conversion process, RGB data for the pixels are converted to CMYK data that correspond to ink colors. It should be noted that, after the color conversion process, the data is CMYK data with 256 gradations expressed in CMYK color space. Hereinafter, CMYK data obtained by subjecting RGB image data to color conversion processing is referred to as "CMYK image data".

The halftone processing section 170 performs a halftone process in which data of a high number of gradations is converted to data of a number of gradations that can be formed by the inkjet printer 1. The halftone process is, for example, a process by which data expressing 256 gradations is converted to 1-bit data expressing two gradations or 2-bit data expressing four gradations. In the halftone process, pixel data is created such that the inkjet printer 1 can form dispersed dots using methods such as dithering, gamma correction, and error diffusion. During the halftone process, the halftone processing section 170 references a dither table when performing dithering, references a gamma table when performing gamma correction, and references an error memory for storing diffused error when performing error diffusion. Data subjected to halftone processing has a resolution (for example, 720×720 dpi) equivalent to the above-mentioned RGB data. Halftone-processed data is constituted by, for example, 1-bit or 2-bit data for each pixel. Hereinafter, in regard to halftone-processed data, 1-bit data is referred to as binary data and 2-bit data is referred to as multi-value data.

The rasterization processing section 172 performs a rasterization process in which data such as the binary data or the multi-value data obtained after the halftone process by the halftone processing section 170 is changed in the order to be transferred to the inkjet printer 1. Thus, the rasterized data is output to the inkjet printer 1.

Head Controller

Figure 6:
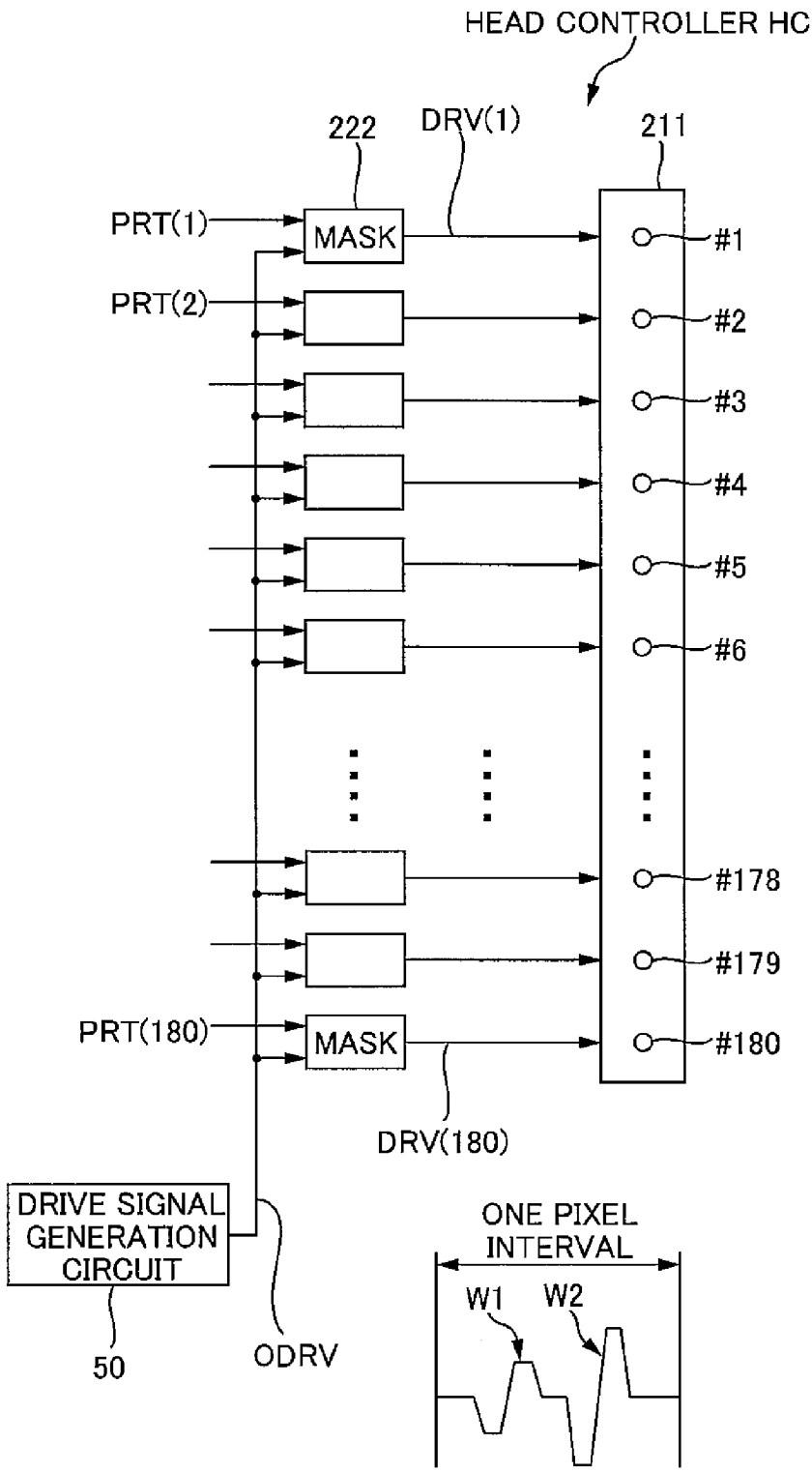
FIG. 6 is an explanatory diagram of a head controller.

FIG. 6 describes the head controller HC. As shown in FIG. 6, the head controller HC includes a plurality of mask circuits 222. The mask circuits 222 are provided corresponding to a plurality of piezo elements for causing ink to be ejected independently from the nozzles #1 to #180 of the head 21. A drive signal ODRV generated and outputted by the drive signal generation circuit 50 is inputted to each mask circuit 222. As shown in a lower portion of FIG. 6, the drive signal ODRV is a signal that includes two pulses, a first pulse W1 and a second pulse W2 in an interval for one pixel (within a time during which the carriage 41 passes through the spacing of one pixel).

A print signal PRT(i) is inputted to each mask circuit 222. The print signal PRT(i) is a signal generated based on a head control signal outputted from the CPU 72, and is pixel data corresponding to each pixel. The print signal PRT(i) is, for example, a binary signal containing two-bit information for a single pixel. The bits respectively correspond to the first pulse W1 and the second pulse W2. The mask circuits 222 are gates for blocking the original drive signal ODRV or letting it pass through depending on the level of the print signal PRT(i). More specifically, when the print signal PRT(i) is at a level "0", the pulse of the original drive signal ODRV is blocked, but when the print signal PRT(i) is at a level "1", the pulse corresponding to the original drive signal ODRV is allowed to pass through as it is and is outputted as an actual drive signal DRV toward the piezo elements of the nozzles #1 to #180. The piezo elements of the nozzles #1 to #180 are driven based on the actual drive signal DRV from the mask circuits 222 and causes ink to be ejected from corresponding nozzles.

Signal Waveforms

Figure 7:
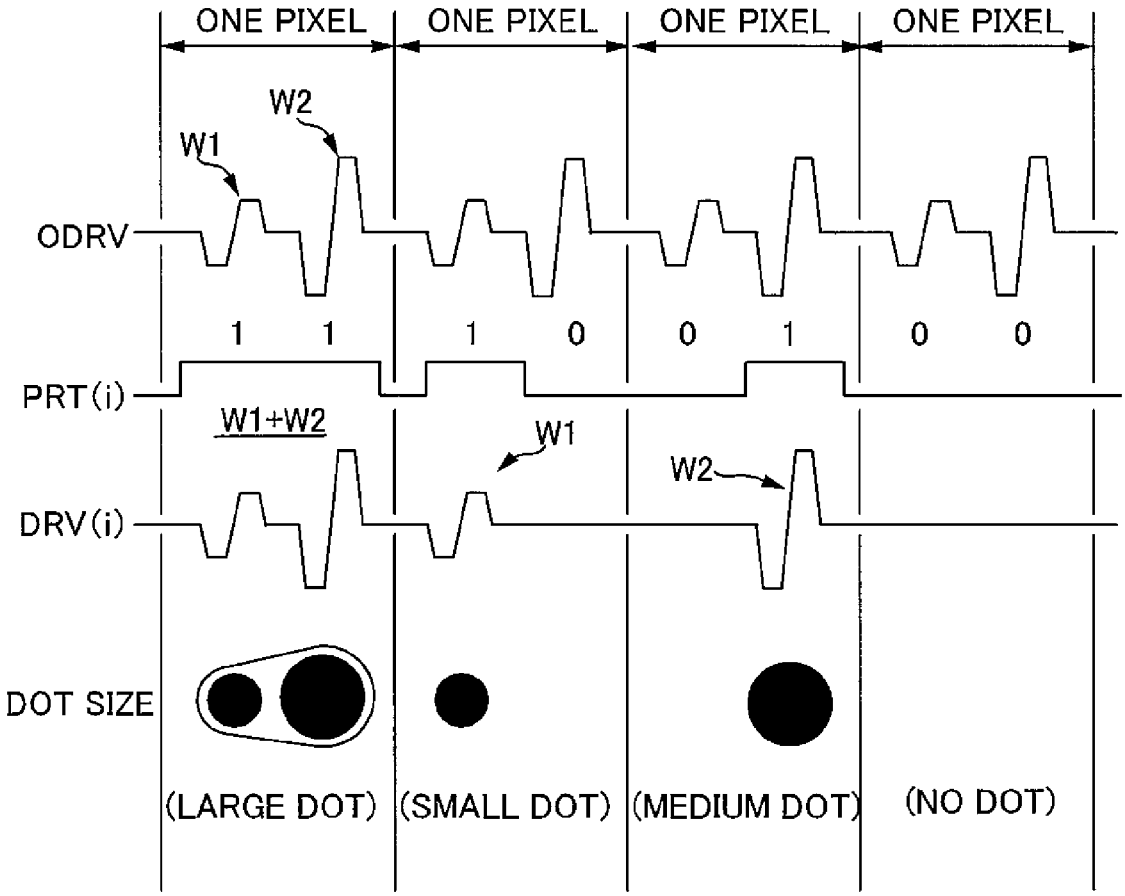
FIG. 7 is a timing chart for respective signals of the head controller.

FIG. 7 is a timing chart of the drive signal ODRV, the print signal PRT(i), and the actual drive signal DRV(i) for describing the operation of the head controller HC. As shown in FIG. 7, the drive signal ODRV generates the first pulse W1 and the second pulse W2 in order during the interval corresponding to a single pixel. Herein, when the print signal PRT(i) corresponds to 2-bit pixel data "10", then only the first pulse W1 is outputted in the first half of one pixel interval. Accordingly, a small ink droplet is ejected from the nozzles #1 to #180, and a dot of a small size (small dot) is formed on the medium S. Furthermore, when the print signal PRT(i) corresponds to 2-bit pixel data "01", then only the second pulse W2 is outputted in the second half of one pixel interval. Accordingly an ink droplet of a medium size is ejected from the nozzles #1 to #180, and a dot of a medium size (medium dot) is formed on the medium S. Furthermore, when the print signal PRT(i) corresponds to 2-bit pixel data "11", then the first pulse W1 and the second pulse W2 are outputted during one pixel interval. Accordingly an ink droplet of a large size is ejected from the nozzles #1 to #180, and a dot of a large size (large dot) is formed on the medium S.

As described above, the actual drive signal DRV(i) in one pixel interval is shaped such that it has three different waveforms depending on three different values of the print signal PRT(i), and based on these signals, the head 21 can form dots of three sizes and can adjust the amount of ink ejected during a pixel interval. Furthermore, if the print signal PRT(i) corresponds to 2-bit pixel data "00", no ink droplet is ejected from the nozzles #1 to #180 and no dot is formed on the medium S.

In the inkjet printer 1 of the present embodiment, the head controller HC of the nozzles #1 to #180 is provided separately for each of nozzle rows 211C, 211M, 211Y, 211K1, and 211K2, such that piezo elements are separately driven for each of the nozzles #1 to #180 of each of the nozzle rows 211C, 211M, 211Y, 211K1, and 211K2.

Conventional Problems and Solutions

Conventional Problems

In the inkjet printer described above, of the two ink cartridges 24A and 24B that contain the same color of ink, when the remaining amount of ink contained in one of the ink cartridges has become small, the other cartridge that contains the same color of ink is used. For this reason, in order to check the remaining amount of ink contained in the mounted ink cartridges 24A and 24B, the computer 110 side makes an inquiry from time to time to the inkjet printer 1 for the remaining amount of ink, each time the printing process is carried out.

However, making inquiries by the computer 110 side for the remaining amount of ink in each cartridge each time the inkjet printer 1 performs the printing process makes the communications between the computer and the inkjet printer complicated, and may interrupt the processes performed by the computer side, which has been a problem.

Solutions

Accordingly, in the present embodiment, the computer 110 does not make an inquiry to the inkjet printer 1 for the remaining amount of ink in the ink cartridges 24A, 24B, 26A, 26B, and 26C mounted to the inkjet printer 1, until the remaining amount of ink contained in the ink cartridges 24A, 24B, 26A, 26B, and 26C has become a predetermined amount or lower, in order to mitigate communications between the inkjet printer 1 and the computer 110. Specifically, the inkjet printer 1 notifies the computer 110 of the remaining amount of ink only after the remaining amount of ink in the ink cartridges 24A, 24B, 26A, 26B and 26C of the inkjet printer 1 has become a predetermined amount or lower.

Furthermore, of the ink cartridges 24A, 24B, 26A, 26B, and 26C mounted to the inkjet printer 1, as for the two black ink cartridges 24A and 24B that contain the same color of ink, when the remaining amount of ink in one of the ink cartridges has become a predetermined amount or lower, the other ink cartridge is used as a substitute cartridge.

Then, after there is a notification from the inkjet printer 1 that there is an ink cartridge with an ink remaining amount that is a predetermined amount or lower, the computer 110 requests for information relating to the ink remaining amount of the substitute cartridge to the inkjet printer 1 each time it generates print data and transmits it to the inkjet printer 1, and obtains the information relating to the ink remaining amount of the substitute cartridge from the inkjet printer 1. In this way, the computer 110 manages the ink remaining amount of the substitute cartridge.

Communications Between Computer and Printer

Figures 8, 9:
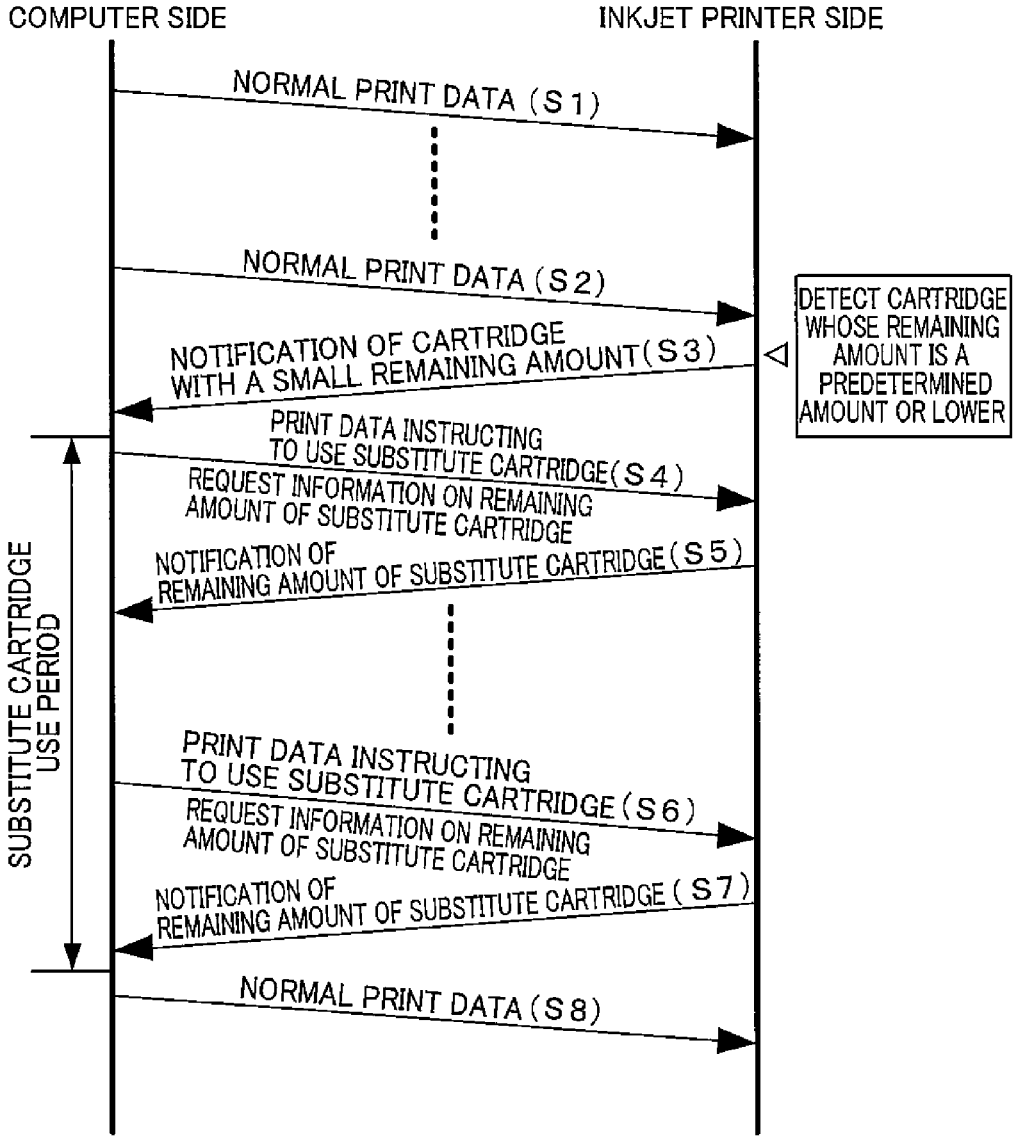
FIG. 8 is an explanatory diagram of communications between an inkjet printer and a computer.
FIG. 9 is an explanatory diagram of a calculation method of an ink consumption amount.

FIG. 8 schematically illustrates communications between the inkjet printer 1 and the computer 110.

When the black (K) ink cartridges 24A and 24B mounted to the inkjet printer 1 contain a sufficient amount of ink, the computer 110 generates the normal print data with the printer driver and transmits the print data to the inkjet printer 1 (S1 to S2).

Then, when the remaining amount of black (K) ink contained in one of the two black (K) ink cartridges 24A and 24B mounted to the inkjet printer 1 has become a predetermined amount or lower, the inkjet printer 1 notifies the computer 110 of the presence of the ink cartridge whose the remaining amount of ink has become a predetermined amount or lower (S3). At this time, the inkjet printer 1 (the controller 70 as the first controller) transmits to the computer 110 the information relating to the ink cartridge whose remaining amount of ink has become a predetermined amount or lower. That is, the inkjet printer 1 notifies the computer 110 in which of the two black (K) ink cartridges 24A and 24B the remaining amount of ink has become a predetermined amount or lower.

It should be noted that the "predetermined amount" used here is not necessarily limited to a small remaining amount of ink. For example, the predetermined amount may be set to half an amount of ink that can be contained in the ink cartridges 24A and 24B, or one-third or quarter of such an amount. The method for detecting the remaining amount of ink in the two black (K) ink cartridges 24A and 24B of the inkjet printer 1 is described later. Also in this description, the ink cartridge whose remaining amount of ink has become a predetermined amount or lower is hereinafter also referred to as a "cartridge with a small remaining amount". Accordingly, information relating to the ink cartridge whose remaining amount of ink has become a predetermined amount or lower corresponds to "information relating to the cartridge with the small remaining amount".

Upon being notified by the inkjet printer 1 that the remaining amount of ink in one of the two black (K) ink cartridges 24A and 24B has become a predetermined amount or lower, when thereafter the computer 110 transmits print data to the inkjet printer to cause the inkjet printer to perform the printing process, the computer 110 uses a different ink cartridge as a substitute cartridge, namely, the other black (K) ink cartridge in this case, instead of the cartridge with the small remaining amount whose remaining amount of ink has become a predetermined amount or lower. Specifically, the computer 110 (the second controller) generates print data instructing to use the other ink cartridge as a substitute cartridge, instead of print data instructing to use the cartridge with the small remaining amount. Thus, consumption of ink remaining in the cartridge with the small remaining amount whose remaining amount of ink has become a predetermined amount or lower is suppressed. The method carried out here for generating the print data instructing to use the other ink cartridge as a substitute cartridge is described later in detail.

Then, the computer 110 (the second controller) transmits to the inkjet printer 1 the generated print data instructing to use the other ink cartridge as a substitute cartridge (S4, S6). At this time, the computer 110 requests to the inkjet printer 1 information relating to the ink remaining amount of the ink cartridge that is to be used as the substitute cartridge (S4, S6).

The inkjet printer 1 (the controller 70 as the first controller), according to the request for information relating to the ink remaining amount of the substitute cartridge from the computer 110, transmits to the computer 110 information relating to the ink remaining amount of the other ink cartridge that becomes the substitute cartridge (S5, S7).

It is possible for the computer 110 (the second controller) to manage the ink remaining amount of the substitute cartridge, based on the information relating to the ink remaining amount of the substitute cartridge transmitted from the inkjet printer 1. That is, for example, the computer 110 compares the remaining amount of ink contained in the substitute cartridge and the ink remaining amount of the cartridge with the small remaining amount, determines a difference between the ink remaining amount of the substitute cartridge and the ink remaining amount of the cartridge with the small remaining amount, and checks how much the ink remaining amount of the substitute cartridge has come close to the ink remaining amount of the cartridge with the small remaining amount. Here, by checking whether or not the difference between the ink remaining amount of the substitute cartridge and the ink remaining amount of the cartridge with the small remaining amount is equal to or lower than a predetermined value, it is possible to easily check whether or not the ink remaining amount of the substitute cartridge has come close to the ink remaining amount of the cartridge with the small remaining amount. Further, the checking is performed each time the information relating to the ink remaining amount is received, so that it is possible to accurately perform the remaining amount management. Further, in this case, the computer 110 corresponds to the "remaining amount information obtaining section".

Here, a value close to zero for example is set as a predetermined value. By setting the predetermined value to a value close to zero, it is possible to detect that the remaining amount of ink in the substitute cartridge has approached the remaining amount of ink in the cartridge with the small remaining amount. Also, by setting the predetermined value to a value smaller than zero, it is possible to detect that the remaining amount of ink in the substitute cartridge has become less than the remaining amount of ink in the cartridge with the small remaining amount.

When the calculated difference is a predetermined value or lower, the computer 110 (the second controller) can stop using the other ink cartridge (in this case, the black (K) ink cartridge) as the substitute cartridge instead of the cartridge with the small remaining amount, when thereafter causing the inkjet printer to perform the printing process, for example. Specifically, the computer 110 can stop generating print data instructing to use the ink contained in the substitute cartridge instead of print data instructing to use the ink contained in the cartridge with the small remaining amount. Thus, for example, when the computer 110 thereafter causes the inkjet printer 1 to perform the printing process, the computer 110 generates normal print data instructing to use the ink contained in the cartridge with the small remaining amount.

On the other hand, if the calculated difference is not a predetermined value or lower, the computer 110 can continue to generate print data instructing to use the substitute cartridge.

Detection of Remaining Amount of Ink

Now, an example of the method of detecting the remaining amount of ink in the black (K) ink cartridges 24A and 24B in the inkjet printer 1 is described.

In the present embodiment, the remaining amounts of ink in the black (K) ink cartridges 24A and 24B are detected by counting the number of ink droplets ejected from the respective nozzles #1 to #180 for each of the first black nozzle group 211K1 and the second black nozzle group 211K2. That is, the controller 70 (the first controller) calculates the consumption amounts of ink for each of the two black (K) ink cartridges 24A and 24B by counting the number of ink droplets ejected from the respective nozzles #1 to #180 of the first black nozzle group 211K1 and the second black nozzle group 211K2. Then, the controller 70 obtains the remaining amounts of ink in each of the two black (K) ink cartridges 24A and 24B by subtracting these consumption amounts of ink from the initial amounts of ink contained in the ink cartridges 24A and 24B. It should be noted that the number of ink droplets ejected from the respective nozzles #1 to #180 of the first black nozzle group 211K1 and the second black nozzle group 211K2 are counted by the head unit 40, for example, other than the controller 70. In such a case, the controller 70 or the head unit 40 corresponds to a "remaining amount detecting section".

FIG. 9 describes a method of calculating the ink consumption amount of the ink cartridges 24A and 24B in the present embodiment. In this embodiment, ink droplets in different quantities are ejected from the respective nozzles #1 to #180 of the first black nozzle group 211K1 and the second black nozzle group 211K2 as ink droplets, as described in FIG. 7. That is, ink droplets for forming "small dot", "medium dot", and "large dot" are ejected. It should be noted that a "large dot" is formed by successively ejecting a "small dot" and a "medium dot".

For this reason, the ink consumption amount varies depending on the size of ink droplets ejected from the respective nozzles #1 to #180 of the first black nozzle group 211K1 and the second black nozzle group 211K2. In short, for example, as shown in FIG. 9, it is assumed that the ink ejection amount for a "large dot" is "$\alpha$" (pl: picoliter), that for a "medium dot" is "$\beta$" (pl) and that for a "small dot" is "$\gamma$" (pl).

When 1000 "large dots", 1500 "medium dots", and 2000 "small dots" are ejected from a single nozzle, the ink consumption amount Qi of that nozzle can be obtained by the following equation (1).

$$Qi=\alpha\times1000+\beta\times1500+\gamma\times2000 \quad (1)$$

In this manner, each time the printing process is performed with the nozzles #1 to #180 of the first black nozzle group 211K1 and the second black nozzle group 211K2, the number of ink droplets ejected from the respective nozzles #1 to #180 is counted and the ink consumption amount Qi is obtained for each of the nozzles #1 to #180. By adding the ink consumption amounts Qi obtained for the respective nozzles #1 to #180, the ink consumption amounts for each of the nozzle group 211K1 and the nozzle group 211K2 can be easily calculated.

Then, the remaining amounts of ink in the ink cartridges 24A and 24B can be obtained by subtracting the ink consumption amounts obtained for each of the nozzle groups 211K1 and 211K2 from the already-known amount of ink initially contained in the respective black (K) ink cartridges 24A and 24B.

It should be noted that in the inkjet printer 1 an ink discharging process called flushing, in which ink is forcibly ejected from the respective nozzles #1 to #180 in order to eliminate problems such as clogging of the nozzles in the head 21, is carried out. The controller 70 (the first controller) counts the ink droplets ejected from the respective nozzles #1 to #180 also in this ink discharging process. Therefore, the inkjet printer 1 side can precisely detect the ink consumption amount.

Processes by the Computer

Generation of Print Data Instructing to Use the Substitute Cartridge

Upon being notified by the inkjet printer 1 that a cartridge with a small remaining amount whose remaining amount of ink has become a predetermined amount or lower is present, when the computer 110 causes the inkjet printer 1 to perform the printing process, the computer 110 (the second controller) generates print data instructing to use a different ink cartridge, namely, the other black (K) ink cartridge in this case, as a substitute cartridge instead of the cartridge with the small remaining amount whose remaining amount of ink has become a predetermined amount or lower.

The method of generating such print data instructing to use the substitute cartridge will now be described. In this embodiment, when the remaining amount of ink in one of the two black (K) ink cartridges 24A and 24B has become a predetermined amount or lower, print data instructing to use the other ink cartridge as the substitute cartridge is generated. Since the two ink cartridges 24A and 24B contain the same color of ink, that is black (K) ink, it is possible to cope with such use of the substitute ink cartridge by modifying the rasterization process by the rasterization processing section 172 described in FIG. 5.

That is, when rasterization processing section 172 performs the rasterization process on the binary data or multi-value data obtained after the halftone process by the halftoning process section 170, which is a process for rearranging the data in the order to be transferred to the inkjet printer 1, the rasterization processing section 172 performs the rasterization process so as to use only the black nozzle group corresponding to the substitute cartridge instead of using the black nozzle group corresponding to the cartridge with the small remaining amount. At this time, in this embodiment, as described in FIG. 3, the second black nozzle group 211K2 is disposed so as to be shifted in the transport direction relative to the first black nozzle group 211K1 by half the nozzle pitch, that is (k/2·D). Therefore, the rasterization processing section 172 performs the rasterization process in accordance with such shifted disposition.

The computer 110 generates the print data instructing to use the substitute cartridge each time the computer 110 causes the inkjet printer 1 to perform the printing process.

Overall Process Flow

Figure 10:
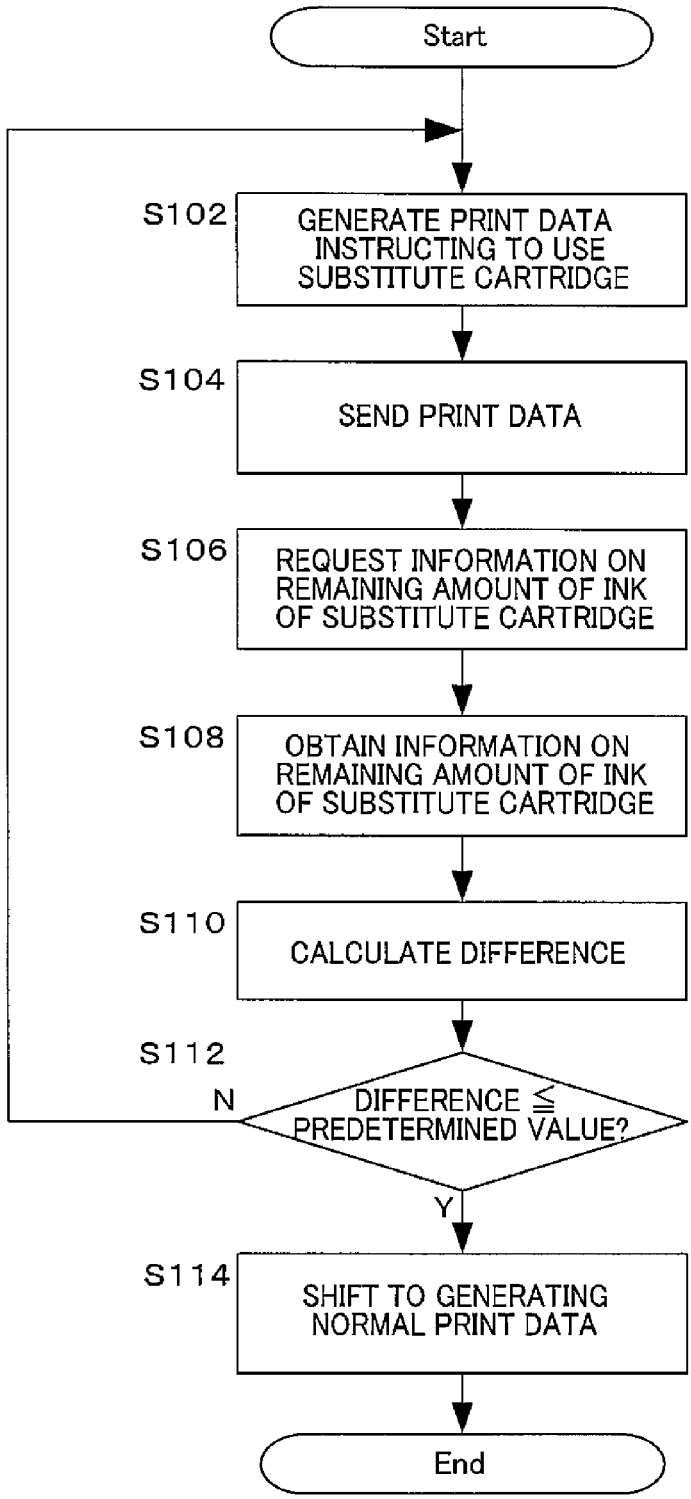
FIG. 10 is a flowchart illustrating processes performed by the computer.

FIG. 10 is a flowchart schematically illustrating the overall process flow performed by the computer 110 as the second controller. Here, the process performed after the inkjet printer 1 (the controller 70 as the first controller) has notified that the remaining amount of ink in a certain ink cartridge became a predetermined amount or lower is described.

Upon having been notified by the inkjet printer 1 that the cartridge with the small remaining amount whose remaining amount has become a predetermined amount or lower has been detected, in order to use the other ink cartridge whose remaining amount has not become a predetermined amount or lower as a substitute cartridge instead of the cartridge with the small remaining amount, the computer 110 generates print data instructing to use that substitute cartridge (S102). In this case, print data instructing to use the substitute cartridge is generated by the above-described method.

Then the computer 110 transmits the print data generated in this way to the inkjet printer 1 (S104). Further, at this time the computer 110 requests information relating to an ink remaining amount of the substitute cartridge to the inkjet printer 1 (S106). According to such a request, the inkjet printer 1 transmits information relating to the ink remaining amount of the substitute cartridge to the computer 110. The computer 110 receives information relating to the ink remaining amount that has been transmitted from the inkjet printer 1 (S108).

Then, the computer 110 calculates the difference between the remaining amounts of ink in the substitute cartridge and the cartridge with the small remaining amount, based on the obtained information relating to the ink remaining amount of the substitute cartridge from the inkjet printer 1 (S110). Then, the computer 110 checks whether or not the calculated difference is equal to or less than a predetermined value (S112). If the calculated difference is a predetermined amount or lower, the computer 110 changes print data to be generated thereafter from the print data instructing to use the substitute cartridge to the print data instructing to use the cartridge with the small remaining amount (S114). After that, the computer 110 terminates the process.

On the other hand, if the calculated difference is not a predetermined amount or lower, the process returns to step S102 and print data instructing to use the substitute cartridge is again generated at the next print command (S102). The computer 110 continues to generate print data instructing to use the substitute cartridge until the difference between the remaining amounts of ink in the substitute cartridge and the cartridge with the small remaining amount becomes a predetermined amount or lower.

Other Embodiments

In the embodiment described above, an inkjet printer to which two black (K) ink cartridges 24A and 24B are mounted is described as an example. Therefore, when the remaining amount of ink in one of the two black (K) ink cartridges 24A and 24B has become a predetermined amount or lower, it is possible to use the same color of ink by using the other ink cartridge as a substitute cartridge. In this manner, the timing to replace the cartridge can be postponed. However, the invention is not necessarily limited to the case in which the same color of ink is used. Specifically, even if an ink cartridge whose remaining amount of ink has become a predetermined amount or lower contains black (K) ink, it is possible to use an ink cartridge that contains a different color of ink, for example, cyan (C), magenta (M) or yellow (Y) as a substitute cartridge.

In addition, even if the ink cartridge whose remaining amount of ink has become a predetermined amount or lower is not an ink cartridge that contains black (K) ink, it is possible to use an ink cartridge that contains a different color of ink as a substitute cartridge, taking account of hue, or the like.

Specifically, as a substitute for an ink cartridge that contains yellow (Y) ink, an ink cartridge that contains red (R) ink or green (G) ink for example can be used. Also, as a substitute for an ink cartridge that contains magenta (M) ink, an ink cartridge that contains red (R) ink, blue (B) ink, or violet (Vi) ink can be used. As a substitute for an ink cartridge that contains cyan (C) ink, an ink cartridge that contains green (G) ink, blue (B) ink, or violet (Vi) ink for example can be used.

Summary

In the present embodiment, an inquiry for the remaining amount of ink in the ink cartridges 24A, 24B, 26A, 26B, and 26C is not made by the computer 110 as the second controller to the inkjet printer 1 (the controller 70 as the first controller) until the remaining amount of ink contained in the ink cartridges 24A, 24B, 26A, 26B, and 26C mounted to the inkjet printer 1 has become a predetermined amount or lower (that is, until the information relating to the cartridge with the small remaining amount is received). Therefore, the burden involved in communications between the inkjet printer 1 and the computer 110 can be mitigated.

Furthermore, when the remaining amount of ink in one of the two black (K) ink cartridges 24A and 24B mounted to the inkjet printer 1 has become a predetermined amount or lower, the other ink cartridge that contains the same color of ink is used as a substitute cartridge. Therefore, the printing process can be continued without interruption.

Further, after the cartridge with the small remaining amount has been detected, the computer 110 successively obtains information relating to the ink remaining amount of the substitute cartridge from the inkjet printer 1. Therefore, it is possible for the computer 110 to easily manage the remaining amount of ink in the substitute cartridge.

Other Embodiments

Although the invention was described using an embodiment, the above-described embodiment was used solely for the purpose of facilitating the understanding of the invention and should not be construed to limit the invention. The invention can of course be altered and improved without departing from the gist thereof and includes functional equivalents. In particular, embodiments described below are also included in the invention.

Before the Remaining Amount of Ink has Become a Predetermined Amount or Lower

In the embodiment described above, before the remaining amount of ink in one of the two ink cartridges 24A and 24B has become a predetermined amount or lower (that is, before the information relating to the cartridge with the small remaining amount is received), one of the two ink cartridges may be continuously used, or the two ink cartridges may be used alternately. When two ink cartridges are used alternately, for example, the ink cartridge to be used is changed for each job or each page (in other words, the print data is generated so as to instruct to change ink cartridges to be used for each job or each page). In this manner, it is possible to prevent a situation in which the remaining amount of ink in one of the cartridges is significantly smaller compared with the remaining amount of ink in the other ink cartridge.

In this manner, even when two ink cartridges are used alternately, the consumption amount of ink differs for each job or each page, and consequently it is possible that the remaining amount of ink in one of the ink cartridges becomes significantly smaller compared with the remaining amount of ink in the other ink cartridge. For this reason, it is possible to employ the embodiment described above also in the case in which two ink cartridges are used alternately.

After the Difference has Become a Predetermined Amount or Lower

In the embodiment described above, when the difference between the remaining amounts of ink in the substitute cartridge and the cartridge with the small remaining amount has become a predetermined amount or lower, normal printing process is carried out. However, there is no limitation to this.

For example, when the difference between the remaining amounts of ink in the substitute cartridge and the cartridge with the small remaining amount has become a predetermined amount or lower, the remaining amount of ink in both ink cartridges is small. Therefore, the computer 110 may request information relating to the remaining amount of ink in both ink cartridges for each print job. In such a case, it is desirable that the computer 110 generates print data instructing to use only the ink cartridge with the larger remaining amount of ink, based on the information relating to the remaining amount of ink in both ink cartridges transmitted (obtained) from the inkjet printer 1. In this manner, it is possible to use both cartridges in which a small amount of ink is left equally.

Alternatively, when the difference between the remaining amounts of ink in the substitute cartridge and the cartridge with the small remaining amount becomes a predetermined amount or lower, the information relating to the remaining amount of ink in the ink cartridge used in the previous job only may be requested. That is, the invention is not limited to embodiments in which information relating to the remaining amount of ink in both ink cartridges is requested. It should be noted that the information relating to the remaining amount of ink in only the ink cartridge used in the previous print job is requested because the ink in the ink cartridge that has not been used in the previous print job has not decreased, and therefore the already obtained information relating to the remaining amount of ink can be used as is. However, the information relating to the remaining amount of ink in the ink cartridge that was not used in the previous print job may be requested even if the cartridge has not been used for printing, when an operation for ejecting ink for preventing ink from thickening in nozzles (operation called flushing) is performed for that cartridge.

Liquid

In the embodiment described above, ink is used in the description as an example of "liquid". However, any type of liquid may be used as "liquid" in the invention.

Liquid Ejection Apparatus

In the embodiment described above, a device that ejects ink as liquid onto a medium is described as an example of "liquid ejection apparatus". However, any type of apparatus may be used as a "liquid ejection apparatus" in the invention as long as that apparatus ejects liquid. Typical examples of this include printing apparatuses (methods) for printing patterns on cloths, circuit board manufacturing apparatuses (methods) for forming circuit patterns on circuit boards, DNA chip manufacturing apparatuses (methods) for manufacturing DNA chips by applying a solution in which DNA is dissolved to a chip, and manufacturing apparatuses (methods) for displays such as organic EL (organic light emitting diode) displays.

Also, the above-described technique can be applied to liquid ejection apparatuses that cause bubbles to be generated in nozzles using a heating element to use these bubbles to eject liquid. In addition, the above-described technique can also be applied to various printing apparatuses such as a line head printer.

Computer

In the embodiment described above, various computers such as a personal computer are used in the description as an example of "computer". However, any type of computer may be used so long as that computer is communicably connected to a liquid ejection apparatus, specifically, connected so that data communications is possible with a liquid ejection apparatus.

Various Controllers

In the embodiment described above, although the controller 70 and the computer 110 are illustrated respectively as the first controller and the second controller, the invention is not limited to such a configuration. For example, a printer that can independently print an image without being connected to a computer (a liquid ejection apparatus in a narrow sense) includes a first control circuit corresponding to the controller 70 and a second control circuit provided with the function of a printer driver. Such a printer can cause the first control circuit to function as the first controller and the second control circuit as the second controller. With such a configuration as well, the same effects can be achieved.

Liquid Ejection Data

In the embodiment described above, "print data" is transmitted from the computer to a liquid ejection apparatus (inkjet printer) as "liquid ejection data". However, the "liquid ejection data" in the invention is not limited to such "print data".

Cartridge

In the embodiment described above, a cartridge that contains ink as liquid is described as an example of "cartridge". However, "cartridge" in the invention is not limited to cartridges that contain ink. In other words, any cartridge that contains liquid and is mounted to a liquid ejection apparatus may be used.

Remaining Amount Detection Section

In the embodiment described above, the "remaining amount detection section" calculates the number of ink droplets ejected from each of the nozzles #1 to #180 to calculate the consumption amount of ink, and detects the remaining amount of ink in the ink cartridges based on the consumption amount. However, the "remaining amount detection section" in the invention is not necessarily required to use such a method to detect the remaining amount of ink in the cartridges. In other words, the "remaining amount detection section" in the invention may detect the remaining amount using any method as long as it detects the remaining amount of liquid such as ink contained in the cartridges. Specifically, the remaining amount in the cartridges may be detected by providing various sensors such as an optical sensor for example.

Substitute Cartridge

In the embodiment described above, although an ink cartridge that contains the same color of ink (here, a cartridge that contains black (K) ink) is used as "substitute cartridge", "substitute cartridge" in the invention is not limited to a cartridge that contains the same color of ink. In other words, "substitute cartridge" in the invention may be any cartridge so long as it can be used instead of "cartridge with a small remaining amount". That is, when cartridges that contains two or more different colors of ink can be used instead of a cartridge that contains a certain color of ink, those cartridges that contains two or more different colors of ink are also included in "substitute cartridge".

What is claimed is:

1. A liquid ejection controlling method comprising:

(A) a remaining amount detecting step of detecting a remaining amount of a liquid contained for each of a plurality of cartridges containing the liquid to be ejected from nozzles, the remaining amount detecting step being performed by a first controller;

(B) an information transmitting step of transmitting information relating to a cartridge with a small remaining amount, when the remaining amount of the liquid in at least one of the cartridges is detected to be equal to or lower than a predetermined amount, the cartridge with the small remaining amount corresponding to the at least one of the cartridges, the information transmitting step being performed by the first controller;

(C) a liquid ejection data generating step of generating and transmitting liquid ejection data for controlling ejection of a liquid contained in a substitute cartridge, by determining at least one cartridge other than the cartridge with the small remaining amount as the substitute cartridge based on the information, relating to the cartridge with the small remaining amount, that has been transmitted, the liquid ejection data generating step being performed by a second controller; and (D) a remaining amount information obtaining step of obtaining information relating to a remaining amount of the liquid of the substitute cartridge from the first controller each time a process of transmitting the liquid ejection data is performed, after the information relating to the cartridge with the small remaining amount has been received, the remaining amount information obtaining step being performed by the second controller.

2. A liquid ejection controlling method according to claim 1, wherein in the remaining amount information obtaining step the information relating to the remaining amount of the liquid is not obtained from the first controller until the information relating to the cartridge with the small remaining amount has been received.

3. A liquid ejection controlling method according to claim 1, wherein the liquid contained in the substitute cartridge is a same type of liquid as the liquid contained in the cartridge with the small remaining amount.

4. A liquid ejection controlling method according to claim 1, wherein the liquid is ink.

5. A liquid ejection controlling method according to claim 4, wherein the substitute cartridge contains a same color of ink as the ink contained in the cartridge with the small remaining amount.

6. A liquid ejection controlling method according to claim 1, wherein in the liquid ejection data generating step liquid ejection data for controlling ejection of liquids contained in a cartridge serving as the substitute cartridge and a cartridge serving as the cartridge with the small remaining amount is generated and transmitted such that these cartridges are alternately used, until the information relating to the cartridge with the small remaining amount has been received.

7. A liquid ejection controlling method according to claim 1, wherein including:

a difference calculating step of calculating a difference between the remaining amount of the liquid contained in the cartridge with the small remaining amount and the remaining amount of the liquid contained in the substitute cartridge, based on information relating to the remaining amount of the liquid obtained from the first controller, the difference calculating step being performed by the second controller; and a difference determining step of determining whether or not the calculated difference is equal to or lower than a predetermined value, the difference determining step being performed by the second controller.

8. A liquid ejection controlling method according to claim 7, wherein in the remaining amount information obtaining step, when it has been determined that the difference is equal to or lower than the predetermined amount, the information relating to the remaining amount of the liquid in the substitute cartridge and the information relating to the remaining amount of the liquid in the cartridge with the small remaining amount is obtained form the first controller, and wherein in the liquid ejection data generating step a cartridge with the larger remaining amount is determined of the substitute cartridge and the cartridge with the small remaining amount, based on the information relating to the remaining amount of the liquid of the substitute cartridge and the information relating to the remaining amount of the liquid of the cartridge with the small remaining amount, and liquid ejection data for controlling ejection of the Liquid contained in the cartridge with the larger remaining amount is generated and transmitted.

9. A liquid ejection apparatus, comprising:

(A) a first controller that detects a remaining amount of a liquid contained for each of a plurality of cartridges containing the liquid to be ejected from nozzles, and when the remaining amount of the liquid in at least one of the cartridges is detected to be equal to or lower than a predetermined amount, transmitting information relating to a cartridge with a small remaining amount, the cartridge with the small remaining amount corresponding to the at least one of the cartridges; and (B) a second controller that can communicate with the first controller, that generates and transmits liquid ejection data for controlling ejection of the liquid contained in a substitute cartridge, by determining at least one cartridge other than the cartridge with the small remaining amount as the substitute cartridge based on the information, relating to the cartridge with the small remaining amount, that has been transmitted, and that obtains information relating to a remaining amount of the liquid of the substitute cartridge from the first controller each time the liquid ejection data is transmitted, after the information relating to the cartridge with the small remaining amount has been received.

* * * * *